US006843117B2

(12) United States Patent
Kurkjian et al.

(10) Patent No.: US 6,843,117 B2
(45) Date of Patent: Jan. 18, 2005

(54) METHOD AND APPARATUS FOR DETERMINING DOWNHOLE PRESSURES DURING A DRILLING OPERATION

(75) Inventors: Andrew L. Kurkjian, Sugar Land, TX (US); Anthony L. Collins, Houston, TX (US); Angus J. Melbourne, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/064,774

(22) Filed: Aug. 15, 2002

(65) Prior Publication Data

US 2004/0031318 A1 Feb. 19, 2004

(51) Int. Cl.[7] ..... E21B 47/00

(52) U.S. Cl. ..... 73/152.01; 73/152.03; 73/152.46; 175/50

(58) Field of Search ..... 73/152.01, 152.03, 73/152.11, 152.46, 81, 152.22, 152.24, 152.51, 152.21, 152.71, 106; 175/50, 107, 65; 367/84, 85; 166/106, 250.07, 297, 374, 386; 507/121

(56) References Cited

U.S. PATENT DOCUMENTS

| | | | | | |
|---|---|---|---|---|---|
| 4,090,397 | A | * | 5/1978 | Hancock et al. | 73/73 |
| 4,745,802 | A | * | 5/1988 | Purfurst | 73/152.26 |
| 4,833,914 | A | | 5/1989 | Rasmus | |
| 4,860,580 | A | * | 8/1989 | DuRocher | 73/152.26 |
| 4,951,749 | A | * | 8/1990 | Carroll | 166/264 |
| 5,233,866 | A | * | 8/1993 | Desbrandes | 73/152.05 |
| 5,242,020 | A | | 9/1993 | Cobern | |
| 5,339,036 | A | | 8/1994 | Clark et al. | |
| 5,602,334 | A | | 2/1997 | Proett et al. | |
| 5,703,286 | A | * | 12/1997 | Proett et al. | 73/152.05 |
| 5,770,798 | A | | 6/1998 | Georgi et al. | |
| 5,789,669 | A | | 8/1998 | Flaum | |
| 5,803,186 | A | * | 9/1998 | Berger et al. | 175/50 |
| 6,006,834 | A | | 12/1999 | Skinner | |
| 6,026,915 | A | | 2/2000 | Smith et al. | |
| 6,047,239 | A | * | 4/2000 | Berger et al. | 702/9 |
| 6,068,394 | A | | 5/2000 | Dublin, Jr. | |
| 6,230,557 | B1 | | 5/2001 | Ciglenec et al. | |
| 6,263,726 | B1 | | 7/2001 | Hubbell et al. | |
| 6,269,891 | B1 | | 8/2001 | Runia | |
| 6,581,455 | B1 | * | 6/2003 | Berger et al. | 73/152.55 |
| 2002/0046835 | A1 | * | 4/2002 | Lee et al. | 166/250.01 |
| 2002/0060094 | A1 | * | 5/2002 | Meister et al. | 175/50 |

FOREIGN PATENT DOCUMENTS

| | | |
|---|---|---|
| EP | 0 697 501 A2 | 2/1996 |
| EP | 0 697 501 A3 | 7/1997 |
| GB | 2 333 308 | 7/1999 |
| WO | WO 01/33044 A1 | 5/2001 |

OTHER PUBLICATIONS

CD Ward & E Andreassen, "Performance while Drilling Data Improves Reservoir Drilling Performance," *SPE/IADC 37588*, pp. 159–168, SPE/IADC Drilling Conf., Amsterdam NL (Mar. 4–6, 1997).

GR Samuel et al., "Field Validation of Transient Swab/Surge Response with PWD Data," *SPE/IADC 67717*, pp. 1–5, SPE/IADC Drilling Conf., Amsterdam NL (Feb. 27–Mar. 1, 2001).

* cited by examiner

*Primary Examiner*—Hezron Williams
*Assistant Examiner*—Jacques M. Saint-Surin
(74) *Attorney, Agent, or Firm*—Jennie (JL) Salazar; Brigitte L. Echols

(57) ABSTRACT

A method and apparatus is provided to determine downhole pressures, such as annular pressure and/or pore pressure, during a drilling operation. A bottom hole assembly (BHA) of a downhole tool includes one or more pressure equalizing assemblies capable of registering the pore pressure when the BHA is at rest and in contact with the wellbore, and annular pressure of a wellbore when it is not. Wellbore fluid is permitted to enter the pressure equalizing assembly and register an annular pressure measurement. Once the BHA comes into contact with the wellbore and to rest, fluid communication is established between the pressure equalizing assembly and the formation to generate a pore pressure measurement. The pressure equalizing assembly includes a sliding valve selectively moveable between an open and closed position in response to operation of the BHA so that the desired pressure measurement may be taken.

65 Claims, 4 Drawing Sheets

METHOD AND APPARATUS FOR DETERMINING DOWNHOLE PRESSURES DURING A DRILLING OPERATION

BACKGROUND OF INVENTION

This invention relates generally to the determination of various downhole parameters of a wellbore penetrated by a subsurface formation. More particularly, this invention relates to the determination of downhole pressures, such as annular pressure and/or formation pore pressure, during a wellbore drilling operation. In a typical drilling operation, a downhole drilling tool drills a borehole, or wellbore, into a rock or earth formation. During the drilling process, it is often desirable to determine various downhole parameters in order to conduct the drilling process and/or the formation of interest.

Present day oil well operation and production involves continuous monitoring of various subsurface formation parameters. One aspect of standard formation evaluation is concerned with the parameters of downhole pressures and the permeability of the reservoir rock formation. Monitoring of parameters, such as pore pressure and permeability, indicate changes to downhole pressures over a period of time, and is essential to predict the production capacity and lifetime of a subsurface formation, and to allow safer and more efficient drilling conditions. Such downhole pressures may include annular pressure ($P_A$ or wellbore pressure), pressure of the fluid in the surrounding formation ($P_P$ pore pressure), as well as other pressures.

Techniques have been developed to obtain these parameters through wireline logging via a "formation tester" tool. This type of measurement requires a supplemental "trip" downhole with another tool, such as a formation tester tool, to take measurements. Typically, the drill string is removed from the wellbore and a formation tester is run into the wellbore to acquire the formation data. After retrieving the formation tester, the drill string must then be put back into the wellbore for further drilling. Examples of formation testing tools are described in U.S. Pat. Nos.: 3,934,468; 4,860,581; 4,893,505; 4,936,139; and 5,622,223. These patents disclose techniques for acquiring formation data while the wireline tools are disposed in the wellbore, and in physical contact with the formation zone of interest. Since "tripping the well" to use such formation testers consumes significant amounts of expensive rig time, it is typically done under circumstances where the formation data is absolutely needed, or it is done when tripping of the drill string is done for a drill bit change or for other reasons.

Techniques have also been developed to acquire formation data from a subsurface zone of interest while the downhole drilling tool is present within the wellbore, and without having to trip the well to run formation testers downhole to identify these parameters. Examples of techniques involving measurement of various downhole parameters during drilling are set forth in U.K. Patent Application GB 2,333,308 assigned to Baker Hughes Incorporated, U.S. patent application Ser. No. 6,026,915 assigned to Halliburton Energy Services, Inc. and U.S. Pat. No. 6,230,557 assigned to the assignee of the present invention.

Despite the advances in obtaining downhole formation parameters, there remains a need to further develop techniques which permit data collection during the drilling process. Benefits may also be achieved by utilizing the wellbore environment and the existing operation of the drilling tool to facilitate measurements. FIG. 1 shows a typical drilling system and related environment. A downhole drilling tool 100 is extended from a rig 180 into a wellbore 110 and drilling fluid 120, commonly known as "drilling mud", is pumped into an annular space 130 between the drilling tool and the wellbore. The drilling mud performs various functions to facilitate the drilling process, such as lubricating the drill bit 170 and transporting cuttings generated by the drill bit during drilling. The cuttings and/or other solids mix within the drilling fluid to create a "mudcake" 160 that also performs various functions, such as coating the borehole wall. Portions of the drilling tool often scrape against the wellbore wall, push away the mudcake and come into direct contact with the wellbore wall.

The dense drilling fluid 120 conveyed by a pump 140 is used to maintain the drilling mud in the wellbore at a pressure (annular pressure $P_A$) higher than the pressure of fluid in the surrounding formation 150 (pore pressure $P_P$) to prevent formation fluid from passing from surrounding formations into the borehole. In other words, the annular pressure ($P_A$) is maintained at a higher pressure than the pore pressure ($P_P$) so that the wellbore is "overbalanced"($P_A>P_P$) and does not cause a blowout. The annular pressure ($P_A$) must also, however, be maintained below a given level to prevent the formation surrounding the wellbore from cracking, and to prevent lose drilling fluid from entering the surrounding formation. Thus, downhole pressures are typically maintained within a given range.

The downhole drilling operation, known pressure conditions and the equipment itself may be manipulated to facilitate downhole measurements. It is desirable that techniques be provided to take advantage of the drilling environment to facilitate downhole measurements of parameters such as annular pressure and/or pore pressure. It is further desirable that such techniques be capable of providing one or more of the following, among others, measurements close to the drill bit, improved accuracy, simplified equipment, real time data and measurements during the drilling process.

SUMMARY OF INVENTION

A method and an apparatus consistent with the present invention includes an apparatus for measuring downhole pressures. The apparatus is disposed in a downhole drilling tool positionable in a wellbore having an annular pressure therein, the wellbore penetrating a subterranean formation having a pore pressure therein. The apparatus comprises at least one pressure equalizing mechanism and a pressure gauge. The at least one pressure equalizing mechanism is capable of equalizing an internal pressure of the apparatus with one of the annular pressure and the pore pressure. The pressure gauge measures the internal pressure.

In another embodiment, the apparatus comprises a first fluid passage, a second passage, a control valve and a pressure gauge. The first passage is positionable in fluid communication with the formation. The second fluid passage is in fluid communication with the wellbore. The control valve is capable of selectively connecting the first and second passage whereby an internal pressure in the first fluid passage is equalized to one of the annular pressure and the pore pressure. The pressure gauge is connected to the first fluid passage for measuring the internal pressure.

In an embodiment consistent with the present invention, a downhole drilling tool capable of measuring downhole pressures during a drilling operation is provided. The downhole drilling tool is positionable in a wellbore having an annular pressure therein, the wellbore penetrating a subterranean formation having a pore pressure therein. The downhole drilling tool comprises a bit, a drill string, at least one drill collar connected to the drill string, at least one pressure mechanism and a pressure gauge. The pressure mechanism is disposed in the drill collar, the pressure mechanism capable of equalizing an internal pressure of the drill collar with one of the annular pressure and the pore pressure. The pressure gauge for measuring the internal pressure.

Finally, in yet another embodiment consistent with the present invention, a method of measuring downhole pressures during a drilling operation is provided. The drilling operation occurs in a wellbore having an annular pressure therein, the wellbore penetrating a formation having a pore pressure therein. The method comprises the steps of positioning a downhole drilling tool in a wellbore, the downhole drilling tool having a pressure equalizing mechanism therein, equalizing an internal pressure of the downhole drilling tool with one of the annular pressure of the wellbore and the pore pressure of the subterranean formation, and measuring the internal pressure.

There has thus been outlined, rather broadly, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

DETAILED DESCRIPTION

Figure 1:
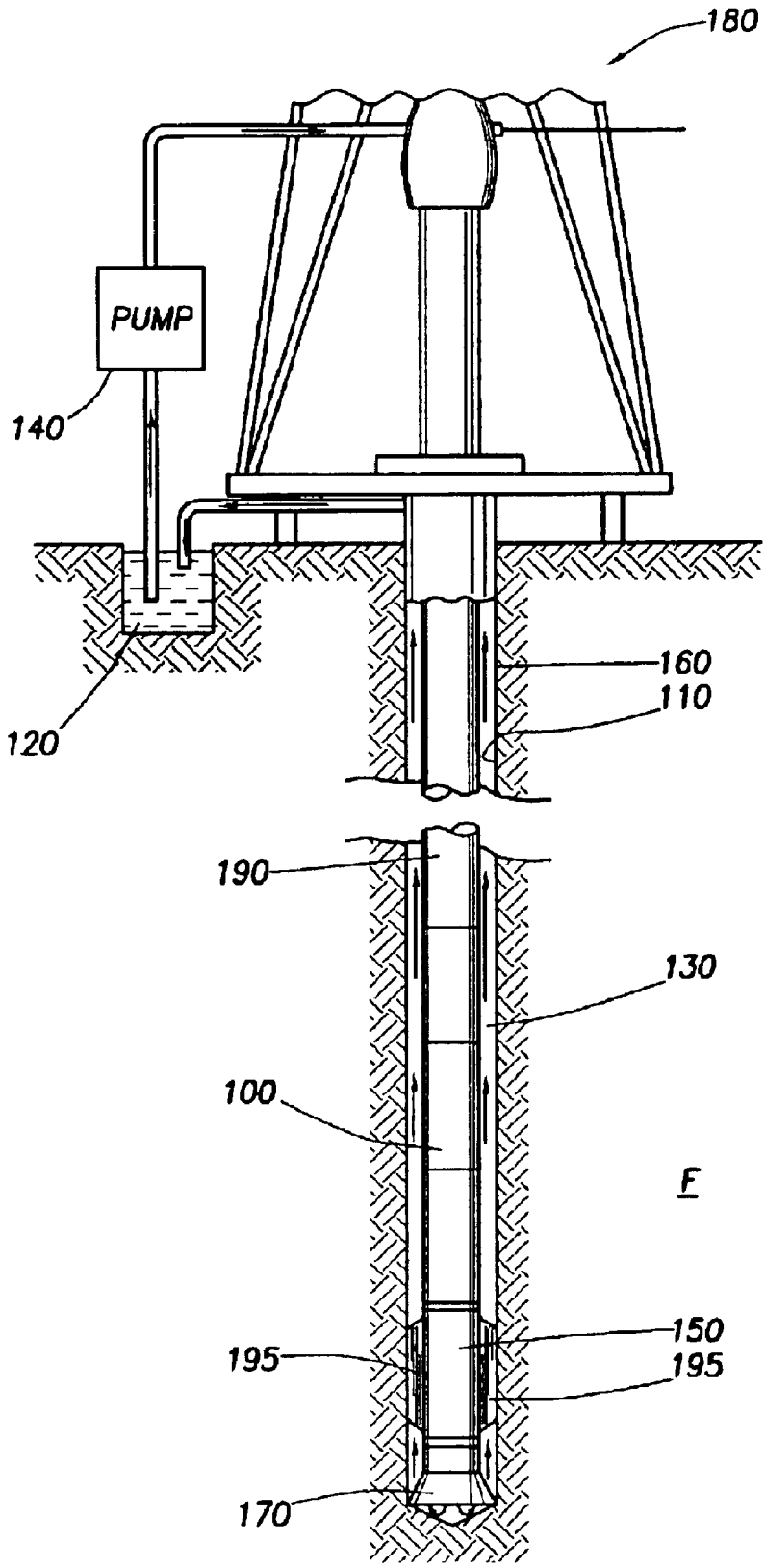
FIG. 1 is an elevational view, partially in section and partially in block diagram, of a conventional drilling rig and drill string employing the present invention.

FIG. 1 illustrates a conventional drilling rig and drill string in which the present invention can be utilized to advantage. Land-based rig 180 is positioned over wellbore 110 penetrating subsurface formation F. The wellbore 110 is formed by rotary drilling in a manner that is well known. Those of ordinary skill in the art given the benefit of this disclosure will appreciate, however, that the present invention also finds application in other drilling applications, such as directional drilling and rotary drilling, and is not limited to land-based rigs.

Drill string 190 is suspended within wellbore 110 and includes drill bit 170 at its lower end. Drilling fluid or mud 120 is pumped by pump 140 to the interior of drill string 190, inducing the drilling fluid to flow downwardly through drill string 190. The drilling fluid exits drill string 190 via ports in drill bit 170, and then circulates upwardly through the annular space 130 between the outside of the drill string and the wall of the wellbore as indicated by the arrows. In this manner, the drilling fluid lubricates drill bit 170 and carries formation cuttings up to the surface as it is returned to the surface for recirculation.

Drill string 190 further includes a bottom hole assembly (BHA), generally referred to as 150. The bottom hole assembly may include various modules or devices with capabilities, such as measuring, processing, storing information, and communicating with the surface, as more fully described in U.S. Pat. No. 6,230,557 assigned to the assignee of the present invention, the entire contents of which are incorporated herein by reference.

As shown in FIG. 1, bottom hole assembly 150 is provided with stabilizer blades 195 extending radially therefrom. One or more stabilizing blades, typically positioned radially about the drill string, are utilized to address the tendency of the drill string to "wobble" and become decentralized as it rotates within the wellbore, resulting in deviations in the direction of the wellbore from the intended path (such as a straight vertical line, curved wellbore or combinations thereof). Such deviation can cause excessive lateral forces on the drill string sections as well as the drill bit, producing accelerated wear. This action can be overcome by providing a means for centralizing the drill bit and, to some extent, the drill string, within the wellbore. Examples of centralizing tools that are known in the art include pipe protectors, wear bands and other tools, in addition to stabilizers.

Figure 2:
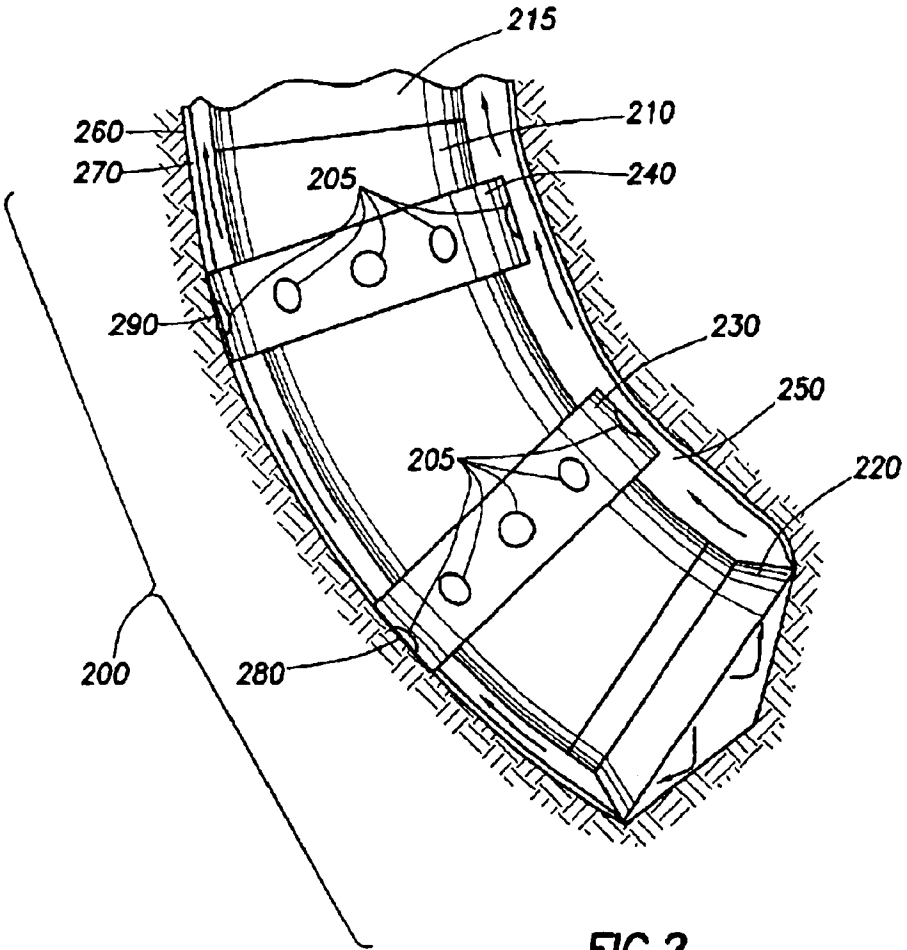
FIG. 2 is an elevational view, partially in cross-section, of a bottom hole assembly (BHA) forming part of a drilling system and having pressure equalizing assemblies in accordance with the present invention.

FIG. 2 depicts a portion of a downhole drilling tool disposed in a wellbore, such as the downhole drilling tool of FIG. 1, having a bottom hole assembly (BHA) 200 illustrating a preferred embodiment of the present invention. The BHA 200, as shown in FIG. 2, includes a drill collar 210 made of metal tubing, a drill bit 220, stabilizer blade 230, wear band 240 and pressure equalizing assemblies 205.

The BHA 200 of FIG. 2 is adapted for axial connection with a drill string 215. Drill collar 210 of FIG. 2 may be equipped with pin and box ends (not shown) for conventional make-up within the drill string. Such ends may be customized collars that are connected to the central elongated portion of drill collar 210 in a manner, such as threaded engagement and/or welding.

Drilling fluid , or drilling mud, flows down the center of the cylindrically-shaped drill collar 210 of the BHA 200, out ports (not shown) in the drill bit 220, up an annular space 250 between the drill collar 210 and the borehole 260, and back up to the surface as indicated by the arrows. The drilling fluid mixes with cuttings from the drill bit 220 under annular pressure ($P_A$) in the wellbore, and forms a mud cake 270 along the walls of the wellbore 260.

As shown in FIG. 2, the BHA 200 is provided with a stabilizer blade 230 positioned in a spiral configuration about drill collar 210. It will, however, be appreciated that a variety of one or more stabilizers may disposed about the drill collar 210, such as the linear stabilizer blades 195 disposed radially about bottom hole assembly 150 of FIG. 1. Other configurations of stabilizers, if present, may be envisioned with various components to enhance the movement and/or stability of the drill collar within the wellbore as described in U.S. Pat. No. 6,230,557, previously incorporated herein.

With continuing reference to FIG. 2, the BHA 200 is also preferably provided with at least one wear band 240 adapted to protect the BHA from damage in the wellbore. As shown in FIG. 2, the wear band 240 is generally circular and extends radially about the drill collar. While FIG. 2 depicts a single, circular wear band extending a given distance radially about the drill collar, it will be appreciated by one of skill in the art that other configurations of one or more wear bands, if present, may be disposed about various portions of the drill collar to provide protection thereto.

The drill bit 220, the stabilizer blade 230 and the wear band 240 are depicted in FIG. 2 as extending a distance radially beyond the drill collar 210, and contacting portions of the borehole. For example, stabilizer blade 230 contacts the borehole at contact surface 280 and wear band 240 contacts the borehole at contact surface 290.

As shown in FIG. 2, portions of the BHA 200 contact the wellbore and scrape away mudcake 270 such that the contact surfaces come in direct contact with the wellbore wall 260.

While contact surfaces 280 and 290 are depicted as being in contact with portions of the wellbore, high vibration, movement in the wellbore, variation in the drilling path and other factors may cause various portions of the BHA 200 to come in contact with the wellbore. Gravitational pull typically causes the contact surfaces on the bottom side of the BHA to contact the lowest points along the wellbore. Additionally, the portions of the BHA extending the furthest from the drill collar typically contact the wellbore. However, other points of contact may occur along other surfaces of the drill collar under various wellbore conditions and with various tool configurations.

Figure 3B:
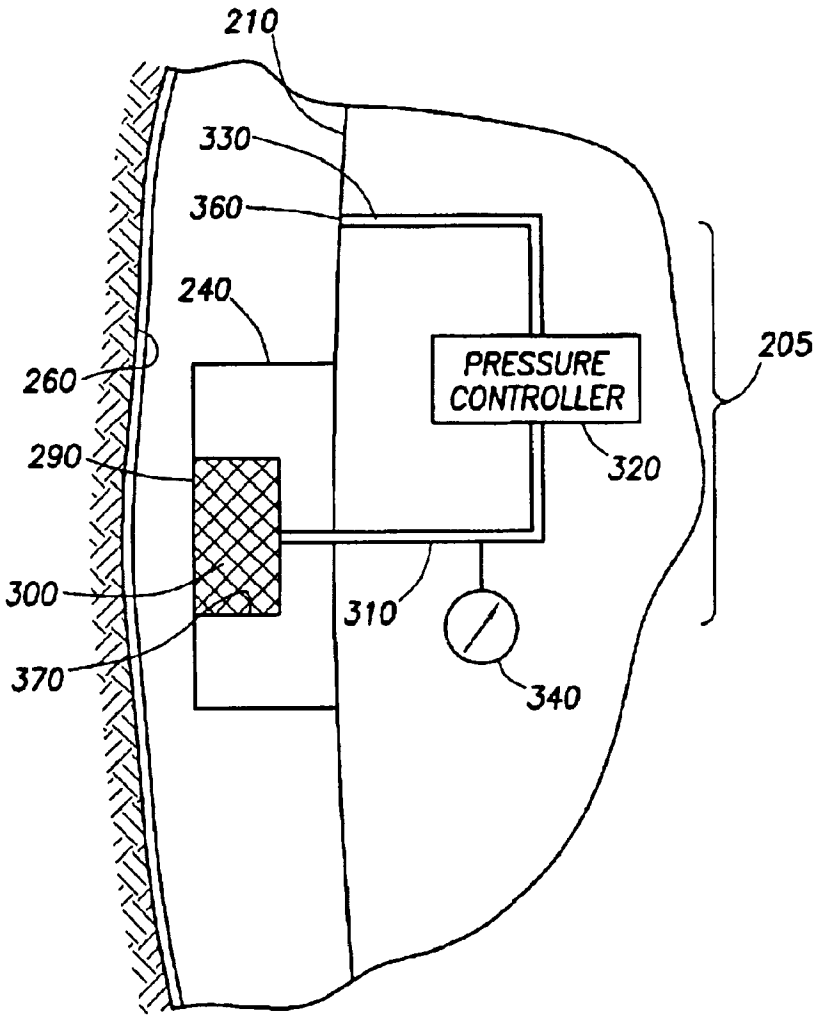
FIGS. 3A and 3B is a cross-sectional view, partially in block diagram, of a pressure equalizing assembly of FIG. 2 in greater detail.
Figure 3A:
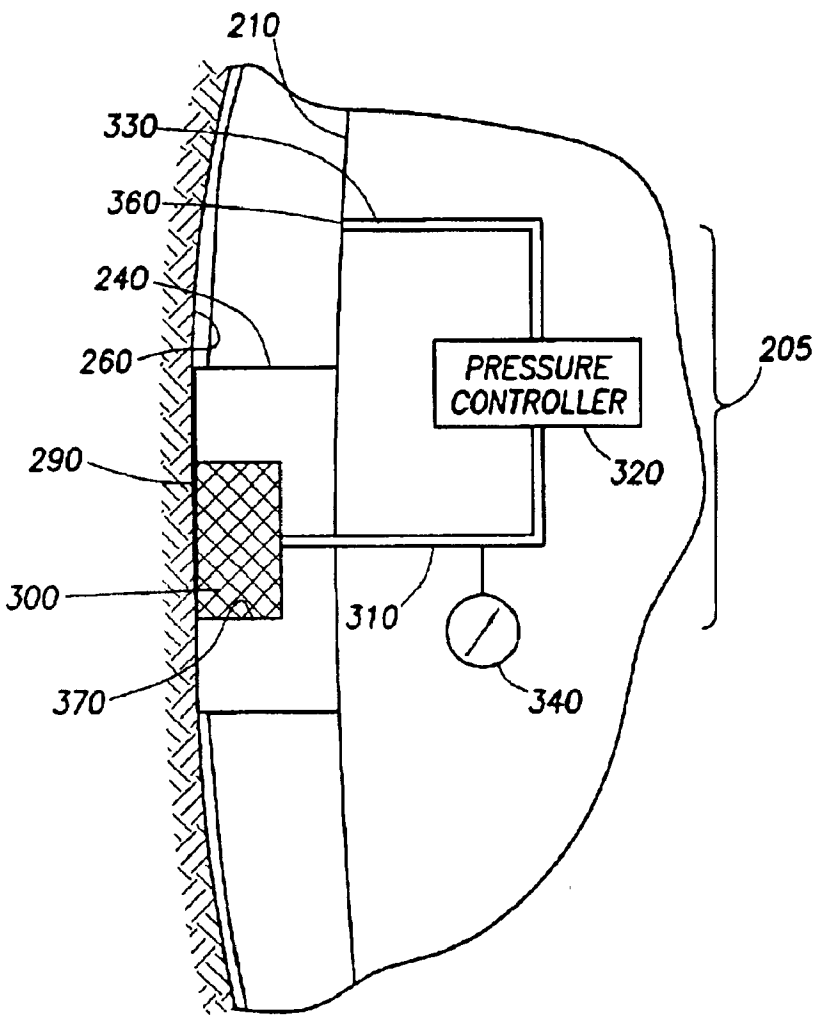

Referring now to FIGS. 3A and 3B, a pressure equalizing assembly positioned in wear ring 240 the BHA of FIG. 2 is depicted in greater detail. FIG. 3A shows the pressure equalizing assembly 205 having a contact surface 290 in engagement with the wellbore 260. FIG. 3B shows the pressure equalizing assembly 205 having a contact surface 290 in non-engagement with the wellbore 260. The preferred embodiment of pressure equalizing assembly 205 includes a filter 300, a first conduit 310, a pressure gauge 340, a pressure controller 320 and a second conduit 330. An opening 370 extends through the contact surface 290 and allows filtered fluids to flow therethrough. An opening 360 extends through a portion of the drill collar 210 and allows fluid to flow therethrough.

Filter 300 is adapted to allow fluids to pass through opening 370 while preventing solids or drilling muds from entering the BHA 200. The filter 300 may be any filter capable of preventing drilling fluids, drilling muds and/or solids from passing into conduit 310 without clogging. An example of a porous solid, such as a sintered metal, usable as a filter may be obtained from GKN Sinter Metals of Richton Park, Ill., available at www.gkn-filters.com. The porous solid may be a porous ceramic.

The first conduit 310 extends from the filter 300 to pressure controller 320, and provides a fluid pathway or chamber between opening 370 and pressure equalizing assembly 390. The second conduit 330 extends from the pressure controller 320 to opening 370, and provides a fluid pathway or chamber from the pressure equalizing assembly 390 to the wellbore.

As shown in FIGS. 3A and 3B, the drill collar 210 is depicted as being in non-engagement with the wellbore 260. In this position, fluid from the wellbore is in fluid communication with second conduit 330. In FIG. 3A, the wear band 240 is in direct contact with the wellbore 260 such that the contact surface 296 is flush thereto, and the first conduit 310 is in fluid communication with the formation. In contrast, as shown in FIG. 3B, the wear band 240 is in non-engagement with the wellbore 260, and fluid in first conduit 310 is no longer in fluid communication with the formation. Because filter 370 prevents drilling muds from entering conduit 310, the first conduit 310 is typically prevented from establishing fluid communication with the wellbore or the mud cake.

The pressure equalizing assembly 205 preferably further includes a pressure gauge 340 to measure the pressure of the drilling fluids in conduit 310. The pressure gauge may be provided with and associated measurement electronics, known as an annular pressure while drilling (APWD) system. The pressure gauge 340 may be used to monitor conditions uphole, provide information for the actuator, check valve or other operational devices and/or to make uphole or downhole decisions using either manual or automatic controls.

Figure 4B:
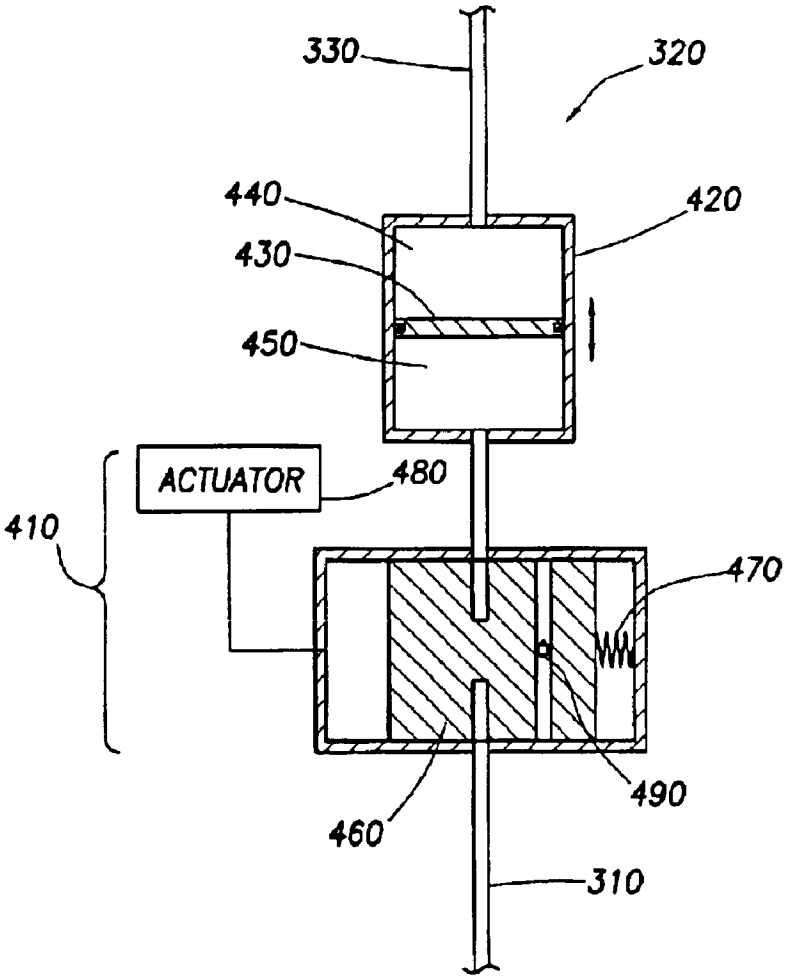
FIGS. 4A and 4B are cross-sectional views, partially in block diagram, of a pressure assembly forming part of the pressure equalizing assembly of FIGS. 3A and 3B.
Figure 4A:
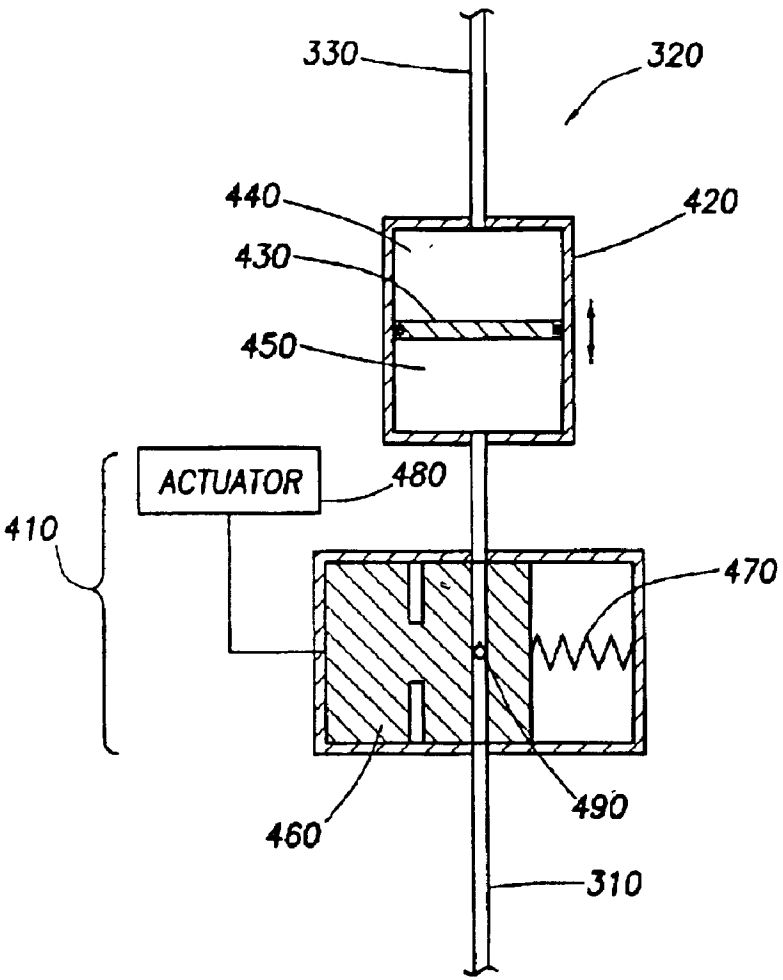

Referring now to FIGS. 4A and 4B, the pressure controller 320 of FIGS. 3A and 3B is shown in greater detail. The pressure controller 320 includes a pressure cylinder 420 and a valve assembly 410. FIG. 4A depicts the valve assembly 410 in the open position, while FIG. 4B depicts the valve assembly 410 in the closed position.

The cylinder 420 of the pressure controller includes a movable fluid separator, such as a piston 430, defining a variable volume drilling fluid chamber 440 and a variable volume buffer fluid chamber 450. The piston 430 moves within the cylinder 420 in response to pressure such that pressure is equalized between the fluid chamber 440 and the buffer chamber 450.

The fluid chamber 440 is in fluid communication with conduit 330. Fluid in chamber 440, therefore, typically contains wellbore fluids flowing into conduit 330 through opening 360 as previously described with respect to FIGS. 3A and 3B. In contrast, buffer chamber 450 of FIGS. 4A and 4B is provided with a buffer fluid used to respond to the fluid pressure in the piston and advance through the pressure equalizing assembly. Preferably, low viscosity hydraulic fluid, such as Exxon Mobil Univis j26, Texaco Hydraulic Oil 5606G, etc., or other fluids, such as nitrogen gas, water, etc. may be utilized. The buffer chamber 450 is in selective fluid communication with conduit 310 via valve assembly 410.

Referring still to FIGS. 4A and 4B, valve assembly 410 preferably includes a sliding valve 460, a spring 470, an actuator 480 and an internal check valve 490. The sliding valve 460 is movable between an open position as depicted in FIG. 4A, and a closed position as depicted in FIG. 4B, to selectively allow pressure equalization between buffer chamber 450 and conduit 310.

The spring 470 of valve assembly 410 is preferably provided to apply a force to maintain the sliding valve in the open position. However, an actuator is preferably provided to selectively move the valve between the open and closed position as will be described further with respect to FIG. 4B. When the activator is not acting upon the valve, the spring will maintain the valve in the open position as depicted in FIG. 4A.

In the open position of FIG. 4A, the sliding valve 460 operatively connects buffer chamber 450 with conduit 310. In other words, sliding valve 460 provides fluid communication between buffer chamber and conduit 310. In this position, pressure equalization may be established between buffer chamber 450 and conduit 310.

Because pressure equalization is already established between buffer chamber 450 and fluid chamber 440, pressure equalization may also be established between conduit 310 and fluid chamber 440 via buffer chamber 450. Thus, in the open position, pressure in conduit 310 equalizes to the same pressure as fluid in the buffer chamber 450, the fluid chamber 440 and the wellbore. Because the pressure in buffer chamber 450 is typically the annular pressure ($A_p$), the pressure gauge 340 (FIG. 3) registers this annular pressure.

Referring back to FIG. 4A, as wellbore fluid enters fluid chamber 440, piston 430 moves within cylinder 420 in response to a change in pressure. The piston adjusts the volume of fluid chamber 440 with respect to buffer chamber 450 until pressure equalizes. Where pressure is higher in conduit 330 than in conduit 310, the piston moves to expand the fluid chamber and contract the buffer chamber. As the buffer chamber contracts, buffer fluid is forced from buffer chamber 450, through sliding valve 460 and out through conduit 310 until the pressure equalizes.

Preferably, a check valve 490 is preferably provided to prevent entry of the fluid from conduit 310 through sliding valve 460 to the buffer chamber 450. The check valve may be either manually or automatically adjusted to control the flow of fluid between the buffer chamber 450 and conduit 310.

Optionally, the valve assembly may be configured such that, where the pressure from conduit 330 and fluid chamber 440 is less than the pressure in buffer chamber 450, piston 430 will move such that the buffer chamber 450 expands and the fluid chamber 440 retracts. Fluid from conduit 330 would then be pushed out of the pressure equalizing mechanism through opening 360 and into the wellbore.

Referring now to FIG. 4B, sliding valve 460 has been shifted from the open position of FIG. 4A to the closed position. The actuator 480 is preferably provided to selectively overcome the force of the spring and move the sliding valve between the open and closed position. The actuator 480 overcomes the force of spring 470 to move the sliding valve 460 to the closed position in responsive to a signal or command.

Preferably, the actuator is capable of moving the valve to the closed position when the drilling operation has stopped and the BHA is at rest. Other signals or commands may be used to signal the actuator to shift the valve between the open and closed position, such as a pressure reading from gauge 340, operator input or other factors. The actuator may be hydraulically, electrically, manually, automatically or otherwise activated to achieve the desired movement of the valve.

In the closed position of FIG. 4B, the sliding valve prevents fluid communication and/or pressure equalization between the buffer chamber 450 and conduit 310. The pressure of conduit 310 when the valve is in the closed position depends on whether contact surface 370 is adjacent the wellbore as in FIG. 3A, or in non-engagement with the wellbore as in FIG. 3B.

When the valve is in the closed position and contact surface 370 is in engagement with the wellbore as shown in FIG. 3A, fluid communication is established between conduit 310 and the formation. Once fluid communication is established, fluid pressures will equalize between the conduit 310 and the fluid in the formation. The pressure in gauge 340 will then read the pressure of the fluid in the formation, namely the pore pressure ($P_P$).

When the valve is in the closed position and contact surface 370 is in non-engagement with the wellbore as shown in FIG. 3B, conduit 310 is isolated from wellbore pressures by the sliding valve 460 at one end and the filter 300 on another end thereof. The conduit 310, therefore, maintains the annular pressure achieve when the sliding valve was in the open position. Thus, the pressure in gauge 340 will continue to read the annular pressure ($P_A$).

While FIGS. 2–4 depict multiple individual equalizing assemblies, it will be appreciated that one or more pressure equalizing assembly may be provided with its own pressure controller, or multiple pressure equalizing assemblies may be operated by the same pressure controller. Conduit 330 may be provided with multiple channels to various openings 370 about the BHA and/or downhole tool. Conduit 310 may be provided with multiple channels to various filters about the BHA and/or downhole tool. Conduits 330 and/or 310 may have channels diverted to various locations about the BHA and/or downhole tool. Valves or other controls or configurations may be envisioned to selectively control fluid flow through the conduits as desired.

In operation, the downhole drilling tool advances to drill the wellbore as shown in FIG. 1. As a BHA or other portion of the drilling tool advances, wellbore fluid is permitted to flow from the wellbore, through opening 360 and into conduit 330 of the pressure equalizing assembly (FIG. 3B). As the drilling tool operates and/or moves through the wellbore, valve assembly 410 remains in the open position (FIG. 4A). In the open position, wellbore fluid is permitted to flow into conduit 330, activate piston 430 and move to equalize pressure in the fluid and buffer chambers. Buffer fluid is in fluid communication with conduit 310 and permits pressure equalization between the buffer chamber and conduit 310. The pressure eventually equalizes to the pressure of the fluid in the wellbore, namely the annular pressure ($P_A$). Pressure gauge 400, therefore, typically registers at the annular pressure ($P_A$) when the drilling process is occurring and/or the sliding valve is maintained in the open position. The pressure equalizing device continues to operate to equalize the annular pressure within the pressure equalizing assembly.

During the drilling process, the BHA of the drilling tool scrapes the sidewall of the wellbore to provide contact between a surface of the BHA and the wellbore. The BHA may come to rest during the drilling process, either due to pauses in the drilling operation or intentional stops for measurements (FIG. 4B). In this position, termination of movement and vibration of the drilling tool signals the actuator to shift the sliding valve to the closed position. The fluid in the conduit 310 is then isolated from the fluid and pressure of the wellbore via the sliding valve at one end and the filter at another end thereof.

If the contact surface of the BHA is in contact with the wellbore wall (FIG. 3A), fluid communication may be established between the formation and conduit 310. Pressure is then equalized between the formation and the conduit 310. Pressure gauge 340, therefore, typically registers the pressure of the fluid in the formation and the conduit, namely the pore pressure ($P_P$). Thus, when contact surface 290 and filter 300 are in contact with the wellbore and the BHA is at rest, the actuator will move to the closed position and pressure will equalize between the first conduit 310 and the fluid formation so that the pressure gauge measures the pore pressure.

On the other hand, if the contact surface of the BHA is in non-engagement with the wellbore wall (FIG. 3B), fluid in conduit 310 is isolated at one end by the closed sliding valve and at the other end by the filter 300. Should the pressure equalizing assembly be at rest in a position where conduit 310 is not in contact with the formation via filter 300, such as when drilling fluid, mud cake or other solids interfere with fluid flow into conduit 310, the fluid in conduit 310 will remain at the equalized pressure and the gauge will continue to read the annular pressure ($P_A$)

The downhole drilling tool may continue through various stops and starts and movement through the wellbore. As the tool stops and starts, the sliding valve will react and selectively establish communication between the conduit 310 and the buffer chamber 450 (FIGS. 4A and 4B). Typically, the drilling tool begins with the sliding valve in the open position and moves to the close position when the tool comes to rest. While in the open position (FIG. 4A), the conduit 310 is typically equalized to the higher annular pressure ($P_A$). When the tool comes to rest (FIG. 4B) and conduit 310 establishes fluid communication with the formation, the pressure in conduit 310 must lower to pore pressure ($P_P$). When the tool begins movement again, the sliding valve resets to the open position and annular pressure is re-established in conduit 310. The various changes in pressure may be monitored and compared with pressures throughout the drilling process and/or as measured by other downhole devices about the BHA. This information may be used to analyze the drilling process and determine various characteristics of the wellbore, formation, drilling tool and/or drilling process, among others.

Figure 5:
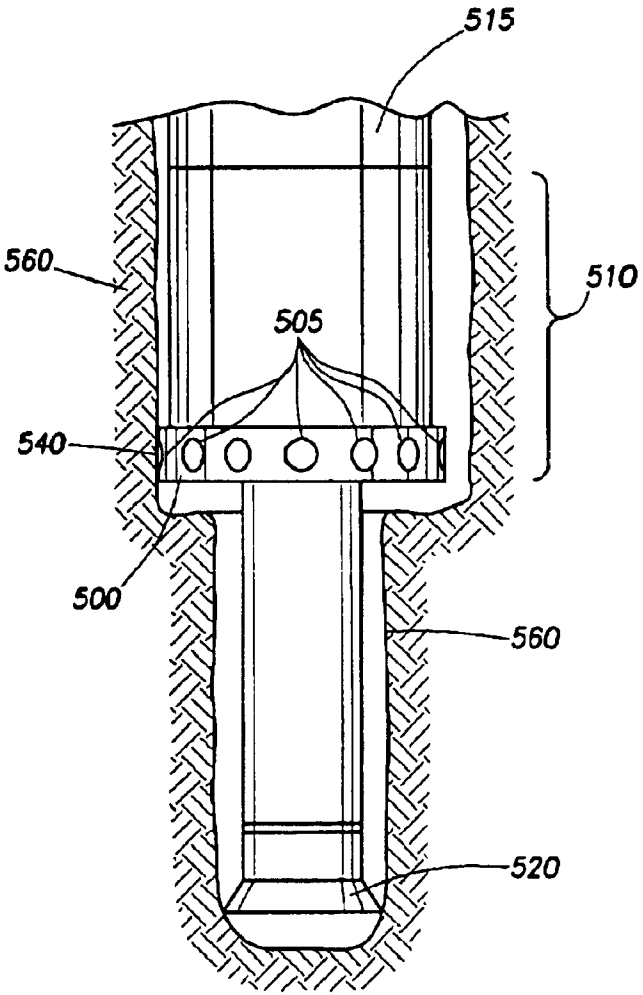
FIG. 5 is an elevational view, partially in cross-section, of an alternate embodiment of the BHA of FIG. 2 including an under reamer.

FIG. 5 shows an alternate embodiment of the BHA 510 of FIG. 2, and is connected to drill string 515 and drill bit 520. The BHA 510 includes an under reamer 500 and pressure equalizing assemblies 505. The BHA 510 is depicted in FIG. 5 has having a contact surface 540 along under reamer 500 in contact with the wellbore 560. In this embodiment, the BHA does not include stabilizers, although stabilizers may optionally be incorporated.

As depicted in FIG. 5, the BHA may be provided with a variety of devices that extend from the drill collar and are capable of providing contact surfaces for pressure equalizing assemblies, such as stabilizers, wear rings, drill bits, under reamers, and other devices. Optionally, pressure equalizing assemblies may also be positioned along the drill collar itself. Additionally, the BHA may be located at various positions along the drill string.

While the invention has been described with respect to a limited number of embodiments, those skilled in the art, having benefit of this disclosure, will appreciate that other embodiments can be devised which do not depart from the scope of the invention as disclosed herein. For example, embodiments of the invention may be easily adapted and used to perform specific formation sampling or testing operations without departing from the spirit of the invention. Accordingly, the scope of the invention should be limited only by the attached claims.

What is claimed is:

1. An apparatus for measuring downhole pressures, the apparatus disposed in a downhole drilling tool positionable in a wellbore having an annular pressure therein, the wellbore penetrating a subterranean formation having a pore pressure therein, the apparatus comprising:

at least one pressure equalizing mechanism capable of selectively equalizing an internal pressure of the apparatus with the annular pressure when in fluid communication with the wellbore and the pore pressure when in fluid communication with the formation; and a pressure gauge for measuring the internal pressure.

2. The apparatus of claim 1, wherein the at least one pressure equalizing mechanism comprises:

a first fluid passage positionable in fluid communication with the formation, the pressure gauge operatively connected to the first fluid passage;

a second fluid passage in fluid communication with the wellbore; and a valve assembly capable of selectively connecting the first and second passages whereby pressure is equalized therebetween.

3. The apparatus of claim 2 further comprising a filter connected to the first passage for preventing the flow of solids into the first passage.

4. The apparatus of claim 3 wherein the filter is a porous solid selected from the group of metal and ceramic.

5. The apparatus of claim 3 wherein the filter is positioned in a protrusion extending from the drilling tool, the filter defining a contact surface disposable adjacent the wall of the wellbore.

6. The apparatus of claim 5, wherein the protrusion forms at least a portion of a bottom hole assembly connected to the downhole drilling tool.

7. The apparatus of claim 5 wherein the protrusion is selected from the group of a wear band, a stabilizer, and an under reamer.

8. The apparatus of claim 2, wherein the second passage comprises a pressure chamber, the pressure chamber having a movable piston therein defining a variable volume fluid chamber and a variable volume buffer chamber, the fluid chamber in fluid communication with the wellbore, the buffer chamber having a buffer fluid therein equalized to pressure in the fluid chamber, the buffer chamber in selective communication with the first passage via the valve assembly.

9. The apparatus of claim 8 wherein the buffer fluid is selected from the group of hydraulic fluid, nitrogen gas and water.

10. The apparatus of claim 8 wherein the valve assembly comprises a sliding valve movable between an open and closed position.

11. The apparatus of claim 10 wherein when the sliding valve is in the closed position and the first passage is in fluid communication with the formation, the fluid m the first passage equalizes to the pore pressure whereby the pressure gauge reads pore pressure.

12. The apparatus of claim 10 wherein when the sliding valve is in the open position, the fluid in the first passage equalizes to the fluid in the second passage whereby the pressure gauge reads annular pressure.

13. The apparatus of claim 10 wherein the valve assembly further comprises an actuator capable of selectively moving the sliding valve between the open and closed position.

14. The apparatus of claim 10 wherein the valve assembly further comprises a check valve for selectively permitting fluid to flow through the sliding valve in the open position.

15. The apparatus of claim 10 wherein the valve assembly further comprises a spring capable of applying force to maintain the sliding valve in one of the open and closed position.

16. An apparatus for measuring downhole pressures, the apparatus disposed in a downhole drilling tool positionable in a wellbore having an annular pressure therein, the wellbore penetrating a subterranean formation having a pore pressure therein, the apparatus comprising:

a first fluid passage positionable in fluid communication with the formation;

a second fluid passage in fluid communication with the wellbore;

a control valve capable of selectively connecting the first and second passage whereby, an internal pressure in the first fluid passage is selectively equalized to one of the annular pressure and the pore pressure; and a pressure gauge connected to the first fluid passage for measuring the internal pressure.

17. The apparatus of claim 16 further comprising a filter connected to the first passage for preventing the flow of solids into the first passage.

18. The apparatus of claim 17 wherein the filter is a porous solid selected from the group of metal and ceramic.

19. The apparatus of claim 17 wherein the filter is positioned in a protrusion extending from the drilling tool, the filter defining a contact surface disposable adjacent the wall of the wellbore.

20. The apparatus of claim 19, wherein the protrusion forms at least a portion of a bottom hole assembly connected to the downhole drilling tool.

21. The apparatus of claim 19 wherein the protrusion is selected from the group of a wear band, a stabilizer, and an under reamer.

22. The apparatus of claim 16, wherein the second passage comprises a pressure chamber, the pressure chamber having a movable piston therein defining a variable volume fluid chamber and a variable volume buffer chamber, the fluid chamber in fluid communication with the wellbore, the buffer chamber having a buffer fluid therein equalized to pressure in the fluid chamber, the buffer chamber in selective communication with the first passage via the control valve.

23. The apparatus of claim 22 wherein the buffer fluid is selected from the group of hydraulic fluid, nitrogen gas and water.

24. The apparatus of claim 23 wherein the control valve comprises a sliding valve movable between an open and closed position.

25. The apparatus of claim 24 wherein when the sliding valve is in the closed position and the first passage is in fluid communication with the formation, the fluid in the first passage equalizes to the pore pressure whereby the pressure gauge reads pore pressure.

26. The apparatus of claim 24 wherein when the sliding valve is in the open position, the fluid in the first passage equalizes to the fluid in the second passage whereby the pressure gauge reads annular pressure.

27. The apparatus of claim 24 wherein the control valve farther comprises an actuator capable of selectively moving the sliding valve between the open and closed position.

28. The apparatus of claim 24 wherein the control valve further comprises a check valve for selectively permitting fluid to flow through the sliding valve in the open position.

29. The apparatus of claim 24 wherein the control valve further comprises a spring capable of applying force to maintain the sliding valve in one of the open and closed position.

30. A downhole drilling tool capable of measuring downhole pressures during a drilling operation, the downhole drilling tool positionable in a wellbore having an annular pressure therein, the wellbore penetrating a subterranean formation having a pore pressure therein, comprising:

a bit;

a drill string;

at least one drill collar connected to the drill string;

at least one pressure mechanism disposed in the drill collar, the pressure mechanism capable of selectively equalizing an internal pressure of the drill collar with one of the annular pressure and the pore pressure; and a pressure gauge for measuring the internal pressure.

31. The apparatus of claim 30, wherein said pressure mechanism comprises: a first fluid passage positionable in fluid communication with the formation, the pressure gauge operatively connected to the first fluid passage;

a second fluid passage in fluid communication with the wellbore; and a valve assembly capable of selectively connecting the first and second passage whereby pressure is equalized therebetween.

32. The apparatus of claim 30 further comprising a filter connected to the first passage for preventing the flow of solids into the first passage.

33. The apparatus of claim 32 wherein the filter is a porous solid selected from the group of metal and ceramic.

34. The apparatus of claim 32 wherein the filter is positioned in a protrusion extending from the drill collar, the filter defining a contact surface disposable adjacent the wall of the wellbore.

35. The apparatus of claim 34 Wherein the protrusion is selected from the group of a wear band, a stabilizer, and an under reamer.

36. The apparatus of claim 31, wherein the drill collar forms at least a portion of a bottom hole assembly connected to the downhole drilling tool.

37. The apparatus of claim 30, wherein the second passage comprises a pressure chamber, the pressure chamber having a movable piston therein defining a variable volume fluid chamber and a variable volume buffer chamber, the fluid chamber in fluid communication with the wellbore, the buffer chamber having a buffer fluid therein equalized to pressure in the fluid chamber, the buffer chamber in selective communication with the first passage via the valve assembly.

38. The apparatus of claim 37 wherein the buffer fluid is selected from the group of hydraulic fluid, nitrogen gas and water.

39. The apparatus of claim 37 wherein the valve assembly comprises a sliding valve movable between an open and closed position.

40. The apparatus of claim 39 wherein when the sliding valve is in the closed position and the first passage is in fluid communication with the formation, the fluid in the first passage equalizes to the pore pressure whereby the pressure gauge reads pore pressure.

41. The apparatus of claim 39 wherein when the sliding valve is in the open position, the fluid in the first passage equalizes to the fluid in the second passage whereby the pressure gauge reads annular pressure.

42. The apparatus of claim 39 wherein the valve assembly further comprises an actuator capable of selectively moving the sliding valve between the open and closed position.

43. The apparatus of claim 39 wherein the valve assembly further comprises a check valve for selectively permitting fluid to flow through the sliding valve in the open position.

44. The apparatus of claim 39 wherein the valve assembly further comprises a spring capable of applying force to maintain the sliding valve in one of the open and closed position.

45. A method of measuring downhole pressures during a drilling operation in a wellbore having an annular pressure therein, the wellbore penetrating a formation having a pore pressure therein, the method comprising:

positioning a downhole drilling tool in a wellbore, the downhole drilling tool having a pressure equalizing mechanism therein;

selectively equalizing an internal pressure of the downhole drilling tool with one of the annular pressure of the wellbore and the pore pressure of the subterranean formation; and measuring the internal pressure.

46. The method of claim 45 further comprising the step of establishing fluid communication between a fluid chamber of the pressure equalizing mechanism and the wellbore.

47. The method of claim 46 further comprising the step of equalizing pressure between a hydraulic chamber of the pressure equalizing mechanism and the fluid chamber.

48. The method of claim 47 further comprising the step of selectively connecting the hydraulic chamber to a measurement chamber via a valve assembly movable between an open and closed position.

49. The method of claim 48 further comprising the step of filtering fluids entering an opening of the measurement passage.

50. The method of claim 48 wherein the step of selectively connecting comprises moving the valve assembly to the closed position when the drilling tool is at rest and to the open position at all other times.

51. The method of claim 50 further comprising the step of equalizing pressure between the hydraulic chamber and the measurement passage when the valve assembly is in the open position.

52. The method of claim 51 wherein the step of measuring the internal pressure comprises measuring the pressure in the measurement passage whereby the annular pressure is determined.

53. The method of claim 50 further comprising the step of positioning an opening of the measurement passage adjacent the wellbore wall.

54. The method of claim 53 wherein the step of positioning comprises positioning an opening of the measurement passage adjacent the wellbore wall by scraping mud away from the wellbore wall so that a contact surface of the pressure equalizing mechanism is disposed adjacent the wellbore wall.

55. The method of claim 53 further comprising the step of establishing fluid communication between the measurement passage and the formation.

56. The method of claim 55 further comprising the step of equalizing pressure between the measurement passage and the formation when the valve is in the closed position.

57. The method of claim 56 wherein the step of measuring the internal pressure comprises measuring the pressure in the measurement passage whereby the pore pressure is determined.

58. The method of claim 49 further comprising the step of equalizing pressure between the formation hydraulic chamber and the measurement passage when the valve assembly is in the closed position.

59. A method of equalizing an internal pressure of a downhole drilling tool disposed in a borehole with one of an annular pressure of the borehole and the pore pressure of a surrounding formation, said method comprising:

allowing drilling fluid in the borehole to enter an opening in the bottom hole assembly and flow into a wellbore cavity;

selectively equalizing pressure between the wellbore cavity and a measurement cavity via a cylinder, the cylinder having a piston therein defining a fluid chamber and a buffer chamber, the wellbore cavity in fluid communication with a wellbore chamber, the buffer chamber in selective fluid communication with the measurement cavity; and taking a pressure reading of the measurement cavity.

60. The method of claim 59 further comprising filtering wellbore fluids from entering the measurement cavity.

61. The method of claim 59 further comprising interrupting fluid communication between the buffer chamber and the measurement cavity when the downhole tool is at rest.

62. The method of claim 61 positioning the measurement cavity in fluid communication with the formation.

63. The method of claim 62 equalizing the pressure between the formation and the measurement cavity.

64. The method of claim 62 wherein the step of equalizing comprises allowing fluid from the measurement cavity to flow between the measurement cavity and the formation until fluid pressure equalizes.

65. The method of claim 63 measuring pressure of fluid in the measurement cavity whereby the pore pressure is determined.

* * * * *